US010835776B2

(12) United States Patent
Jiang

(10) Patent No.: US 10,835,776 B2
(45) Date of Patent: Nov. 17, 2020

(54) PASSIVE-TYPE TREADMILL

(71) Applicant: Peigen Jiang, Sammamish, WA (US)

(72) Inventor: Peigen Jiang, Sammamish, WA (US)

( * ) Notice: Subject to any disclaimer, the term of this patent is extended or adjusted under 35 U.S.C. 154(b) by 176 days.

(21) Appl. No.: 15/818,750

(22) Filed: Nov. 21, 2017

(65) Prior Publication Data

US 2019/0151706 A1 May 23, 2019

(51) Int. Cl.

| | |
|---|---|
| ***A63B 22/02*** | (2006.01) |
| ***A63B 21/015*** | (2006.01) |
| ***A63B 21/008*** | (2006.01) |
| ***A63B 21/00*** | (2006.01) |
| ***A63B 21/012*** | (2006.01) |
| ***A63B 24/00*** | (2006.01) |
| *A63B 71/00* | (2006.01) |

(52) U.S. Cl.

CPC ..... *A63B 22/02* (2013.01); *A63B 21/0088* (2013.01); *A63B 21/00192* (2013.01); *A63B 21/015* (2013.01); *A63B 21/0125* (2013.01); *A63B 22/0285* (2013.01); *A63B 24/0087* (2013.01); *A63B 2022/0278* (2013.01); *A63B 2071/0072* (2013.01); *A63B 2209/00* (2013.01); *A63B 2225/687* (2013.01)

(58) Field of Classification Search

CPC .... A47K 10/12; A47K 10/14; A61B 2017/28; A63B 22/00–208; A63B 2022/0271; A63B 2022/0278; A63B 2225/687; A63B 21/40; A63B 21/4041; A63B 21/4027; A63B 21/4033; A63B 21/4035

USPC ..... 482/54

See application file for complete search history.

(56) References Cited

U.S. PATENT DOCUMENTS

| | | | | | |
|---|---|---|---|---|---|
| 3,952,704 | A * | 4/1976 | Webb | A01K 15/027 | 119/700 |
| 4,538,807 | A * | 9/1985 | Rice | A63B 22/14 | 482/133 |
| 5,226,866 | A * | 7/1993 | Engel | A63B 21/015 | 482/52 |
| 5,586,961 | A * | 12/1996 | Quint | A63B 22/02 | 482/111 |
| 5,960,520 | A * | 10/1999 | Conway | A47C 21/022 | 24/306 |
| 8,550,263 | B2 * | 10/2013 | Martin | A47K 1/08 | 211/105.3 |
| 8,961,373 | B2 * | 2/2015 | Halver | A63B 21/157 | 482/51 |
| 9,849,333 | B2 * | 12/2017 | Fung | A63B 22/0292 | |
| 2003/0134718 | A1 * | 7/2003 | Kim | A63B 22/02 | 482/54 |
| 2003/0171191 | A1 * | 9/2003 | Crawford | B62K 21/12 | 482/57 |

(Continued)

FOREIGN PATENT DOCUMENTS

WO WO-8800850 A1 * 2/1988 ..... A63B 17/00

*Primary Examiner* — Loan B Jimenez
*Assistant Examiner* — Zachary T Moore

(57) ABSTRACT

A passive-type treadmill is disclosed which includes a closed-loop belt rolling around two spaced apart rollers for providing a running platform, a first and a second handrail parallel to each other and extended upward angling to a surface of the closed-loop belt at larger than 45 degrees, and a towel rack having at least a first and a second clip for stretching a towel between the first and the second handrail.

8 Claims, 2 Drawing Sheets

Fig. 2

(56) References Cited

U.S. PATENT DOCUMENTS

| | | | | |
|---|---|---|---|---|
| 2010/0056348 | A1* | 3/2010 | James | A63B 21/015 482/127 |
| 2014/0038788 | A1* | 2/2014 | Goldman | A63B 22/02 482/54 |
| 2014/0274578 | A1* | 9/2014 | Kennedy | A63B 21/015 482/54 |
| 2016/0023039 | A1* | 1/2016 | Cei | A63B 23/04 482/54 |

* cited by examiner

PASSIVE-TYPE TREADMILL

BACKGROUND

The present invention relates generally to a physical exercise apparatus, and, more particularly, to a passive-type treadmill.

Treadmills are widely utilized for performing vigorous exercise indoors and at a stationary position. Such treadmills typically include an elongated closed-loop belt driven by rollers and supported by an underlying rigid deck. The rollers are often driven by an electric motor, typically at an adjustable speed. However, such motorized treadmills are often noisy as a runner pounds the running deck, and can be dangerous if the runner lost a step. What desired is a treadmill that is both quiet and safe.

Figure 1:
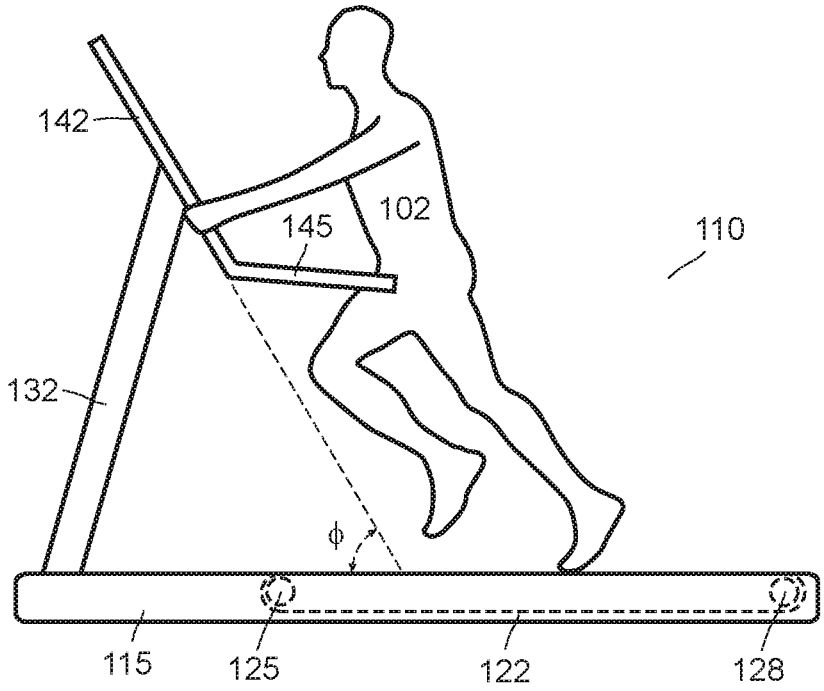
FIG. 1 is a side-view of a passive-type treadmill according to an embodiment of the present disclosure.

The drawings accompanying and forming part of this specification are included to depict certain aspects of the invention. A clearer conception of the invention, and of the components and operation of systems provided with the invention, will become more readily apparent by referring to the exemplary, and therefore non-limiting, embodiments illustrated in the drawings, wherein like reference numbers (if they occur in more than one view) designate the same elements. The invention may be better understood by reference to one or more of these drawings in combination with the description presented herein.

DESCRIPTION

The present disclosure relates to a passive-type treadmill. A preferred embodiment of the present disclosure will be described hereinafter with reference to the attached drawings.

FIG. 1 is a side-view of a passive-type treadmill 110 according to an embodiment of the present disclosure. A person 102 walks on platform 122 leaning slightly forward supporting his upper body with his hands on a handrail 142. The platform 122 is covered by a closed-loop belt rolls around two spaced apart rollers 125 and 128. The belt is supported by a substantially rigid deck (not shown). According to embodiments of the present disclosure, the rollers 125 and 128 is not motorized, so that the person 102 uses his feet to push the belt backward for exercise purposes.

As shown in FIG. 1, the platform 122 is mounted to a frame 115. A support member 132 for the handrail 142 is also mounted to the frame 115. The connections between the support member 132 and the frame 115 as well as the handrail 142 are substantially rigid. As shown in FIG. 1, the handrail has two sections 142 and 145. The handrail section 145 is relatively horizontal oriented compared to the handrail section 142. The reason for the handrail section 142's more upright orientation is because the person 102 pushes against the handrail section 142 during exercise, so that the closed-loop belt can roll clockwise referring to FIG. 1. In embodiments, an angle between the handrail section 142 and a surface of the platform 122, Φ, is larger than 45 degrees and preferably about 60 degrees.

Figure 2:
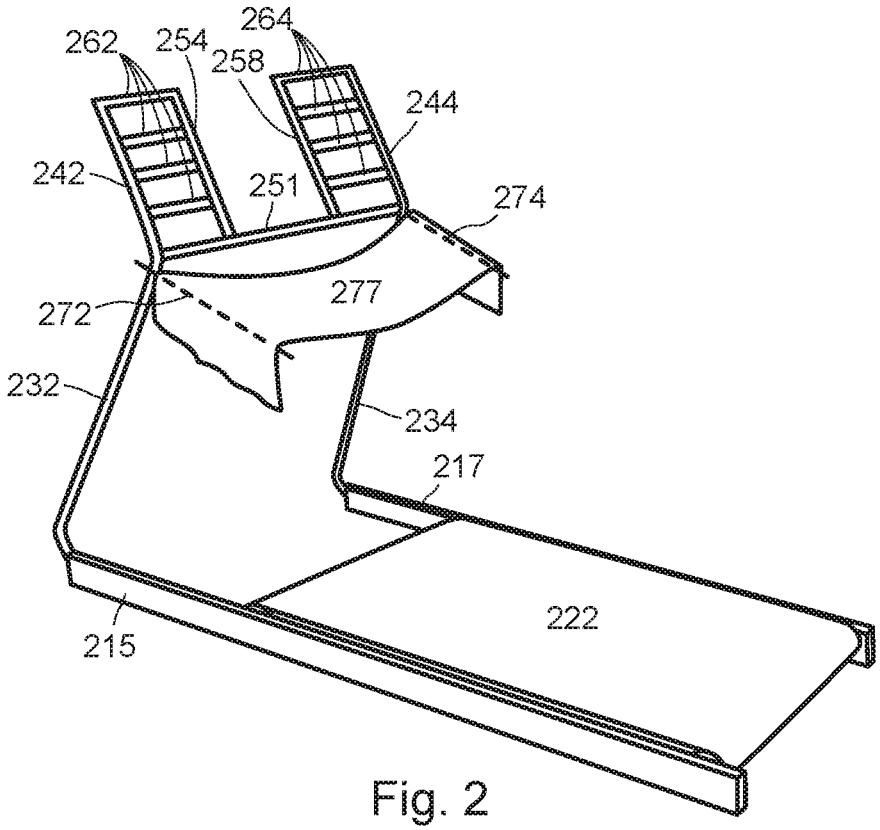
FIG. 2 is a perspective view of a passive-type treadmill according to an embodiment of the present disclosure.

FIG. 2 is a perspective view of a passive-type treadmill according to an embodiment of the present disclosure. A running or walking platform 222 is mounted to frames 215 and 217, which are rigidly connected to support members 232 and 234. The support members 232 and 234 are extended to upright handrails 242 and 244, respectively. The first handrail 242 and the second handrail 244 are connected by a horizontal bar 251. As users of the treadmill may have different height, and the same user may want to switch hand positions, the treadmill of the present disclosure also provides first plurality of horizontal handles 262 connected between the first handrail 242 and a third handrail 254. The third handrail 254 is substantially parallel to the first handrail 242 and an end of the third handrail 254 is connected to the horizontal bar 251. Similarly, a second plurality of horizontal handles 264 are connected between the second handrail 244 and a fourth handrail 258. The fourth handrail 258 is substantially parallel to the second handrail 244, and an end of the fourth handrail 258 is also connected to the horizontal bar 251. There is a gap between the third handrail 254 and the fourth handrail 258, so that a treadmill user's frontal view will not be blocked. In embodiments, the support members 232 and 234, the handrails 242, 244, 254 and 258, the horizontal bar 251 and the handles 262 and 264 are made of steels and connected by welding.

Referring again to FIG. 2, the treadmill of the present disclosure also provides a first rod 272 attached to the support member 232 which is connected to the first handrail 242 and a second rod 274 attached to the support member 234 which is connected to the second handrail 244 for stretching out a towel 277 in front of a user (not shown) to catch sweat. Providing the towel 277 is advantageous because the user may have to use both hands to hold onto the handles 262 and 264, and it will not be easy for the user to use a hand to wipe off sweat during exercise.

Figure 3:
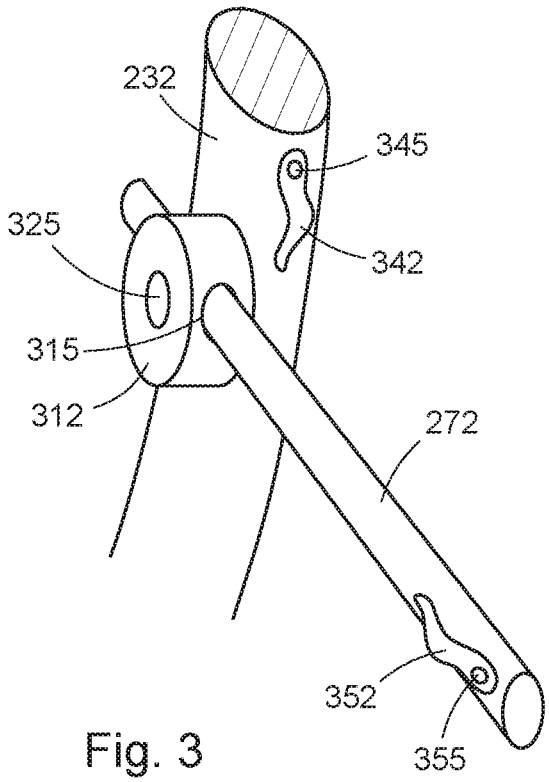
FIG. 3 illustrates a towel rack structure for the treadmill of the present disclosure.

FIG. 3 illustrates a towel rack structure for the treadmill of the present disclosure. The towel rack structure includes the first rod 272 inserted in a hole 315 through a mounting member 312. The first rod 272 can frictionally slide in and out of the hole 315 to accommodate different towel sizes. The mounting member 312 is attached to the support member 232. In embodiments, the mounting member 312 can pivot around a pin 325, and be locked at a certain position. As a result, the first rod 272 can be held at a substantially horizontal position during an exercise session, and be held at a substantially vertical position when the treadmill is not used. In an embodiment, the pin 325 has threads in one end for being screwed into the support member 232. Although FIG. 3 illustrates only the towel rack structure for a left-hand side of the treadmill including the first handrail 242, it is understood that the same structure can be used for the right-hand side of the treadmill including the second handrail 244.

Referring again to FIG. 3, a clip 342 is provided on the support member 232 near the mounting member 312, and another clip 352 is provided to a near end of the rod 272. The clip 342 is exemplarily attached to the support member 232 by a rivet 345. The clip 352 is exemplarily attached to the first rod 272 by a rivet 355. Alternatively, the clip 342 can be attached to a far end of the first rod 272 instead. The clips 342 and 352 can be used to secure a towel to the first rod 272.

Figure 4:
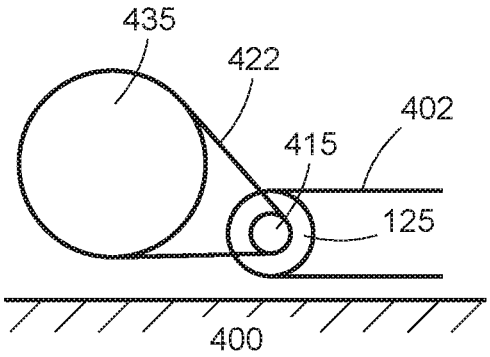
FIG. 4 illustrates a load control structure for the treadmill of the present disclosure.

FIG. 4 illustrates a load control structure for the treadmill of the present disclosure. A part of a closed-loop belt 402 is shown around the roller 125. The belt 402 frictionally engages the roller 125, i.e., when a top portion of the belt 402 moves backward under the push from a user, the roller 125 rotates around a shaft 415 in a clockwise direction. The shaft 415 engages a load control device 435 through a taut cable 422, so that the load control device 435 can apply variable load to the belt 402. As shown in FIG. 4, with the use of the taut cable 422, the load control device 435 can be mounted higher than the roller 125, which can then be mounted as close to the ground 400 as possible. In embodiments, a gap between a lower portion of the belt 402 and the ground can be maintained at approximately 10 millimeters.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A passive-type treadmill comprising:

a closed-loop belt rolled around two spaced apart rollers secured to a frame of the passive-type treadmill for providing a running platform;

a first and a second handrail both secured to the frame and extended upward angling to a running surface of the closed-loop belt at larger than 45 degrees, the first handrail being substantially parallel to the second handrail;

a substantially horizontal crossbar connected between the first and the second handrail;

a first handle directly protruding from the first handrail above the horizontal crossbar, and a second handle directly protruding from the second handrail above the horizontal crossbar, the first and the second handle being spaced apart, a third handrail connected between the first handle and the crossbar, the third handrail being substantially parallel to the first handrail; and a fourth handrail connected between the second handle and the crossbar, the fourth handrail being substantially parallel to the second handrail.

2. The passive-type treadmill of claim 1 further comprising a first rod attached to the first handrail and a second rod attached to the second handrail, the first and the second rod being capable of holding a towel.

3. The passive-type treadmill of claim 1 further comprising a load control device coupled to one of the rollers.

4. The passive-type treadmill of claim 3, wherein the load control device is positioned above a bottom surface of the closed-loop belt.

5. A passive-type treadmill comprising:

a closed-loop belt rolled around two spaced apart rollers secured to a frame of the passive-type treadmill for providing a running platform;

a first and a second handrail both secured to the frame and extended upward angling to a running surface of the closed-loop belt at larger than 45 degrees, the first handrail being substantially parallel to the second handrail;

a substantially horizontal crossbar connected between the first and the second handrail;

a first handle directly protruding from the first handrail above the horizontal crossbar, and a second handle directly protruding from the second handrail above the horizontal crossbar, the first and the second handle being longitudinally substantially aligned in the same straight line but spaced apart; and a third handrail connected between the first handle and the crossbar, the third handrail being substantially parallel to the first handrail, and a fourth handrail connected between the second handle and the crossbar, the fourth handrail being substantially parallel to the second handrail.

6. The passive-type treadmill of claim 5 further comprising a first rod attached to the first handrail and a second rod attached to the second handrail, the first and the second rod being capable of holding a towel.

7. The passive-type treadmill of claim 5 further comprising a load control device coupled to one of the rollers.

8. The passive-type treadmill of claim 7, wherein the load control device is positioned above a bottom surface of the closed-loop belt.

* * * * *